US009933752B2

(12) United States Patent
Asaoka et al.

(10) Patent No.: US 9,933,752 B2
(45) Date of Patent: Apr. 3, 2018

(54) OPTIONAL DEVICE HAVING AIR FLOW SENSOR FOR ELECTRICAL MACHINE, AND ELECTRICAL MACHINE

(71) Applicant: KONICA MINOLTA, INC., Chiyoda-ku, Tokyo (JP)

(72) Inventors: Shogo Asaoka, Toyokawa (JP); Katsumi Kuroyanagi, Toyokawa (JP); Shigeru Sawano, Toyokawa (JP); Hideki Narahashi, Toyokawa (JP); Sho Karakama, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/078,245

(22) Filed: Mar. 23, 2016

(65) Prior Publication Data

US 2016/0282806 A1 Sep. 29, 2016

(30) Foreign Application Priority Data

Mar. 25, 2015 (JP) ..... 2015-063276

(51) Int. Cl.
*G03G 21/20* (2006.01)

(52) U.S. Cl.
CPC ... *G03G 21/206* (2013.01); *G03G 2221/1645* (2013.01)

(58) Field of Classification Search
CPC ..... G03G 21/206; G03G 2221/1645
USPC ..... 399/92, 93
See application file for complete search history.

(56) References Cited

U.S. PATENT DOCUMENTS 4,417,589 A * 11/1983 Favaloro ..... A61B 5/0875 600/529
5,708,938 A * 1/1998 Takeuchi ..... G03G 15/2064 399/250
2006/0059987 A1* 3/2006 Melville ..... G01F 5/00 73/202.5
2007/0009283 A1* 1/2007 Shirakata ..... G03G 21/206 399/92
2011/0200494 A1* 8/2011 Tanaka ..... G03G 21/206 422/211
2015/0168913 A1* 6/2015 Yamaguchi ..... G03G 21/206 399/92

(Continued)

FOREIGN PATENT DOCUMENTS

JP 11-84534 A 3/1999

*Primary Examiner* — David M Gray
*Assistant Examiner* — Laura Roth
(74) *Attorney, Agent, or Firm* — Buchanan Ingersoll & Rooney PC

(57) ABSTRACT

An electrical machine includes an exhaust fan and an exhaust port on which an optional device is mounted. The optional device includes a duct, an electric fan, and an air flow sensor. Through the duct, an exhaust gas from the exhaust port is guided. The electric fan draws in the exhaust gas flowing through the duct and discharges the exhaust gas into an atmosphere. The air flow sensor detects presence or absence of the exhaust gas flowing from the electrical machine. The air flow sensor includes an air path partitioned from an inside of the duct by a partition wall. The air path includes an exhaust gas and an exit port. The exhaust gas intake port includes an opening facing the exhaust gas. The exit port communicates with the atmosphere at a position outside the duct.

11 Claims, 7 Drawing Sheets

(56) References Cited

U.S. PATENT DOCUMENTS

| | | | | |
|---|---|---|---|---|
| 2016/0286668 | A1* | 9/2016 | Tomoda | H05K 7/20181 |
| 2016/0286669 | A1* | 9/2016 | Narahashi | B01D 46/0002 |

* cited by examiner

OPTIONAL DEVICE HAVING AIR FLOW SENSOR FOR ELECTRICAL MACHINE, AND ELECTRICAL MACHINE

CROSS-REFERENCE TO RELATED APPLICATIONS

The present application claims priority under 35 U.S.C. § 119 to Japanese Patent Application No. 2015-63276, filed Mar. 25, 2015. The contents of this application are incorporated herein by reference in their entirety.

BACKGROUND OF THE INVENTION

Field of the Invention

The present invention relates to an optional device for an electrical machine and to an electrical machine.

Discussion of the Background

Electrical machines such as image forming apparatuses emit exhaust gases that contain ultrafine particles (UFPs) of siloxane, which results from heating of silicon, or hydrocarbon, which results from melting of toner at high temperatures. In recent years, stricter regulations have been imposed on ultrafine particles. This requires the electrical machines to use a filter or a similar device to collect ultrafine particles in the exhaust gas and to discharge purified air to the atmosphere. Newly developed electrical machines are designed to satisfy this requirement against ultrafine particles in the exhaust gas. In order for existing electrical machines to satisfy the requirement, a discrete, optional device that has a function to purify the exhaust gas may be added to the existing electrical machines.

The optional device can be powered directly by a commercial power source, instead of by the electrical machine. It is necessary, however, to electrically connect the electrical machine and the optional device to each other in order for the electrical machine to send the optional device electrical signals to control operation of the optional device.

In an exemplary case of an image forming apparatus, while the image forming apparatus is in waiting mode, an exhaust fan is out of operation or rotating at speeds so low that the amount of exhaust gas is negligibly small. Thus, the amount of ultrafine particles in the exhaust gas is negligible. While the image formation unit is in operating mode, the exhaust fan is rotating at full speed, emitting a larger amount of exhaust gas, which contains a larger amount of ultrafine particles. This necessitates control that includes sending the optional device an electrical signal to determine whether the image forming apparatus is in waiting mode or operating mode and making the optional device effect its air purification function while the image forming apparatus is in operating mode.

In order to implement the electrical connection, however, it is necessary to provide, in advance, the electrical machine with an interface (such as a connector) to make the electrical connection with the optional device possible. Providing the interface leads to an increase in cost. For an existing electrical machine without such interface, it is necessary to modify the electrical machine so as to retrieve the electrical signal and implement the electrical connection with the optional device.

In view of this situation, the inventors worked on the development of an optional device that has an air purification function and that can be discretely mountable to image forming apparatuses while eliminating the need for electrical connection. This optional device includes an air flow sensor and a controller. The air flow sensor detects exhaust gas from the image forming apparatus. The controller controls the operation of the air purification function (the operation of an electric fan) based on a detection signal from the air flow sensor. That is, the optional device determines how the image forming apparatus is operating by detecting the exhaust gas from the image forming apparatus, instead of by receiving an electrical signal from the image forming apparatus. This enables the optional device to turn the air purification function into operation at any desirable time.

Japanese Unexamined Patent Application Publication No. 11-84534 discloses a similar optional device for a liquid crystal projector instead for an image forming apparatus. This optional device measures the speed of cool air flow using an air speed sensor and turns off a power source, such as an optical source, based on a detected value of the measured air speed. In this manner, the optional device protects the liquid crystal panel. In this conventional optional device, the air speed sensor is arranged at an exit port of the liquid crystal panel for the cool air flow. This arrangement is intended to eliminate or minimize the influence of the air flow from the exhaust fan and thus to optimize the measurement of the speed of the cool air flow.

In the conventional optional device, the air flow sensor is arranged between the cooling fan of the image forming apparatus and the electric fan of the optional device. This arrangement makes it difficult to detect the presence or absence of the exhaust gas (air flow) from the image forming apparatus while the electric fan of the optional device is in operation. That is, even if there is no exhaust gas from the image forming apparatus, the air flow sensor may possibly erroneously detect an air flow caused by the electric fan of the optional device as the exhaust gas from the image forming apparatus.

Japanese Unexamined Patent Application Publication No. 11-84534 recites that in the optional device for a liquid crystal projector, the air speed sensor is arranged at the exit port of the liquid crystal panel for the cool air flow and that this arrangement minimizes the influence that the air flow from the exhaust fan has on the air speed sensor. However, in optional devices for image forming apparatuses, the air flow sensor has to detect smaller amounts of exhaust gas from the image forming apparatus. Therefore, arranging the air flow sensor adjacent to the exhaust port of the image forming apparatus is not enough to sufficiently diminish the influence of air flow from the operating electric fan of the optional device.

It is an object of the present invention to provide an optional device for an electrical machine that deals with the above-described circumstances. Specifically, the optional device includes an air flow sensor and an electric fan. The air flow sensor detects the presence or absence of an exhaust gas from the electrical machine. The electric fan is controlled in accordance with a detection signal from the air flow sensor. Even while the electric fan of the optional device is in operation, the optional device sufficiently diminishes the influence of the air flow from the electric fan, and thus enables the air flow sensor to accurately detect the presence or absence of the exhaust gas flowing from the electrical machine.

SUMMARY OF THE INVENTION

According to one aspect of the present disclosure, an optional device is for an electrical machine. The electrical machine includes an exhaust fan and an exhaust port on which the optional device is mounted. The optional device includes a duct, an electric fan, and an air flow sensor.

Through the duct, an exhaust gas from the exhaust port is guided. The electric fan is configured to draw in the exhaust gas flowing through the duct and is configured to discharge the exhaust gas into an atmosphere. The air flow sensor is configured to detect presence or absence of the exhaust gas flowing from the electrical machine. The air flow sensor includes an air path partitioned from an inside of the duct by a partition wall. The air path includes an exhaust gas and an exit port. The exhaust gas intake port includes an opening facing the exhaust gas. The exit port communicates with the atmosphere at a position outside the duct.

According to another aspect of the present disclosure, an electrical machine includes an exhaust port, an exhaust fan, and an optional device. The exhaust fan is configured to discharge, through the exhaust port, air in the electrical machine. The optional device is disposed on the exhaust port and includes a duct, an electric fan, and an air flow sensor. Through the duct, an exhaust gas from the exhaust port is guided. The electric fan is configured to draw in the exhaust gas flowing through the duct and configured to discharge the exhaust gas into an atmosphere. The air flow sensor is configured to detect presence or absence of the exhaust gas flowing from the electrical machine. The air flow sensor includes an air path partitioned from an inside of the duct by a partition wall. The air path includes an exhaust gas intake port and an exit port. The exhaust gas intake port includes an opening facing the exhaust gas. The exit port communicates with the atmosphere at a position outside the duct.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
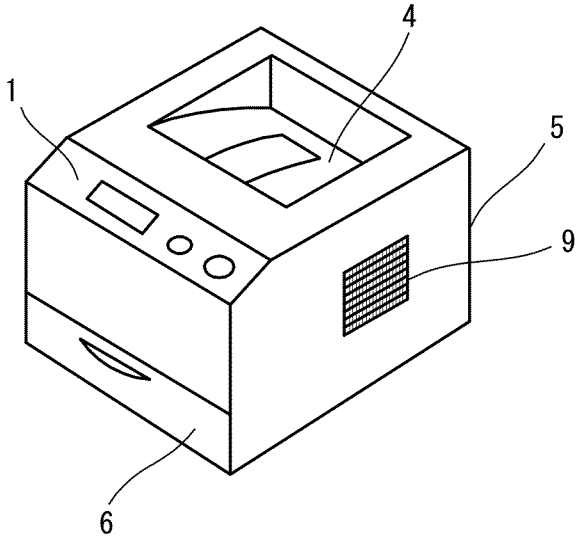
FIG. 1 is a perspective view of a laser printer according to an embodiment as seen from a forward right direction.

The embodiments will now be described with reference to the accompanying drawings, wherein like reference numerals designate corresponding or identical elements throughout the various drawings.

FIG. 1 is a perspective view, as seen from a forward right direction, of a laser printer, which is an exemplary image forming apparatus to which the optional device according to this embodiment is discretely mounted. The following description, as necessary, may refer to particular directions and positions using terms such as "left and right", "up and down (above and below or under)", and "front and rear". These terms are based on the front view of the image forming apparatus, which is an elevational view of the front surface, on which an operation panel 1 is disposed.

The laser printer includes the operation panel 1 and a discharge tray 4. The operation panel 1 is disposed at an upper portion of the front surface of a body 5, and includes a liquid crystal display and operation buttons. The discharge tray 4 is disposed on the upper surface of the body 5 behind the operation panel 1. On the discharge tray 4, printed sheets of paper are discharged and stacked on top of each other. In the body 5, an image formation unit is disposed. The image formation unit includes a photosensitive drum, an exposure device, a developing device, a transfer device, and a fixing device. Under the body 5, a feeding tray 6 is disposed. The feeding tray 6 accommodates recording sheets of paper of a regular size to be fed to the image formation unit.

A sheet of paper sent from the feeding tray 6 is fed to the image formation unit in the body 5. Image data is sent to the laser printer from a personal computer or a similar device connected to the laser printer. Based on the image data, the exposure device is controlled to form an electrostatic latent image on the photosensitive drum. Then, the developing device develops the electrostatic latent image into a toner image. The toner image is transferred onto a sheet of paper at the transfer device and fixed to the sheet of paper by heating at the fixing device. Thus, the sheet of paper fed to the image formation unit receives a toner image while the sheet of paper is being conveyed along a predetermined conveyance path. After the toner image has been fixed to the sheet of paper, the sheet of paper is discharged to the discharge tray 4.

Figure 2:
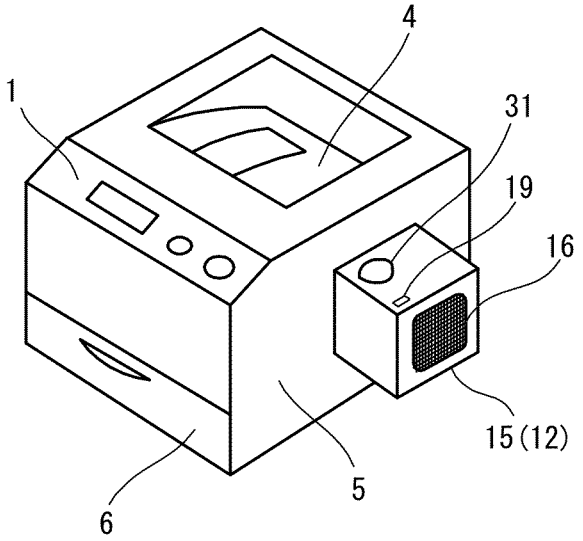
FIG. 2 is a perspective view of the laser printer illustrated in FIG. 1 with an optional device according to another embodiment mounted on the laser printer.
Figure 3:
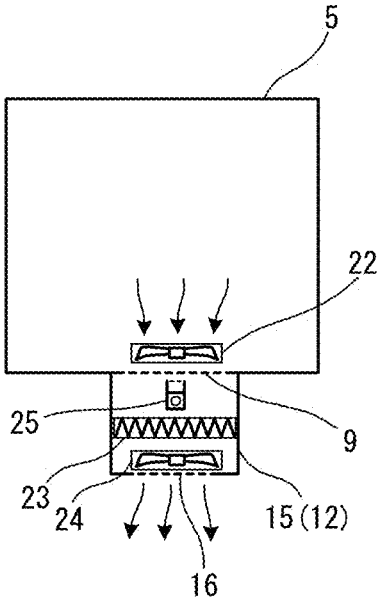
FIG. 3 is a plan view of the optional device and an internal configuration of a body of the laser printer.

On the right side surface of the body 5, an exhaust port 9 is disposed. The exhaust port 9 is covered with a discrete optional device 12 according to this embodiment. FIG. 2 is a perspective view of the laser printer illustrated in FIG. 1 with the optional device 12 mounted on the laser printer. FIG. 3 is a plan view of the optional device 12 and an internal configuration of the body 5 of the laser printer.

In the laser printer according to this embodiment, the exhaust port 9 is disposed on the right side surface of the body 5, and an intake port (not illustrated) is disposed on the left side surface of the body 5. On the inner side of the exhaust port 9, an exhaust fan (cooling fan) 22 is disposed. When external air enters the body 5 of the laser printer through the intake port, the air cools the fixing device and other heating devices of the body 5, and then is discharged to outside the body 5 through the exhaust port 9 by the exhaust fan 22. This exhaust gas (air flow) contains ultrafine particles (UFPs) generated at devices such as the developing device and the fixing device. If the exhaust gas were discharged into the air as it is, it would be impossible to satisfy regulations against ultrafine particles (UFPs) especially in Europe, where these regulations are becoming increasingly stricter. Although this issue is occasionally addressed by providing a filter on the inner side of the exhaust port 9, a simple, comparatively rough filter may not be capable of collecting sufficient amounts of ultrafine particles contained in the exhaust gas (cooling air).

In view of this situation, the optional device 12 is discretely mounted to the laser printer. The optional device 12 includes a duct 15, a high-efficiency particle air filter (hereinafter referred to as HEPA filter) 23, and an electric fan 24. The duct 15 guides the exhaust gas flowing from the exhaust port 9. The HEPA filter 23 is a finely porous filter. Thus, the optional device 12 is a box-shaped clean unit having an air purification function. With the finely porous filter, the optional device 12 collects sufficient amounts of ultrafine particles contained in the exhaust gas flowing from the exhaust port 9, and discharges from the clean unit 12 air purified in the optional device (clean unit) 12. The weight of the optional device (clean unit) 12 is light enough to enable the optional device 12 to be discretely mounted to the body 5 of the laser printer with a double-side tape, an L-shaped metal fitting, or any other connecting means. Also as illustrated in FIG. 2, an indicator 19 is disposed at a corner portion on the upper surface of the clean unit 12. The indicator 19 displays an operation state of the clean unit 12 using a light-emitting diode. A dome-shaped windshield 31 covers the exit port of an air flow sensor, described later, to prevent inflow of external air.

In FIG. 3, which schematically illustrates the body 5 of the laser printer and an internal configuration of the clean unit 12, and in the drawings referred to in the following description, the flow of the exhaust gas, that is, the air flow is indicated by arrow-headed solid lines. The exhaust gas (air flow) discharged from the exhaust port 9 passes through the duct 15 of the clean unit 12 and is guided to the HEPA filter 23. Air purified through the HEPA filter 23 is discharged by the electric fan 24 from an exhaust port 16, which is on the rear surface of the electric fan 24.

The clean unit 12 includes an air flow sensor 25 and a controller. The air flow sensor 25 detects the presence or absence of the exhaust gas flowing from the body 5 of the laser printer so as to detect the mode (waiting mode or printing mode) in which the laser printer is in. Based on a signal output from the air flow sensor 25, the controller controls the operation of the electric fan 24 (that is, the operation of the clean unit 12). Thus, without the need for electrical connection to the laser printer, the clean unit 12 is capable of activating the electric fan 24 (that is, activating the air purification function of the clean unit 12) anytime a need arises in view of the operation mode of the laser printer. It is noted that the power to drive the controller and the electric fan 24 is not supplied from the laser printer but from a commercial power source (AC 100 V), which is supplied to a power source circuit of the clean unit 12.

Figure 4:
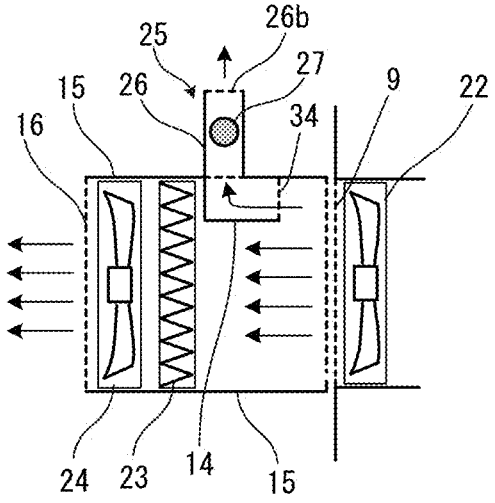
FIG. 4 is a side view of the optional device and a portion of the body of the laser printer in the vicinity of the exhaust port of the body, illustrating internal configurations of the optional device and the portion.
Figure 5:
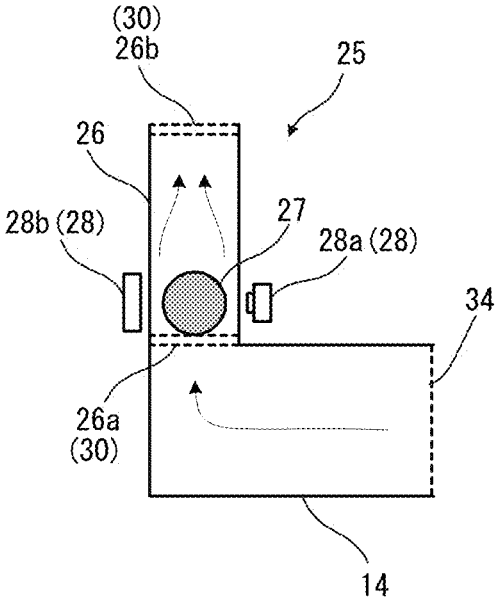
FIG. 5 is a side view of an air flow sensor illustrating an internal configuration of the air flow sensor and a detection principle.
Figure 6:
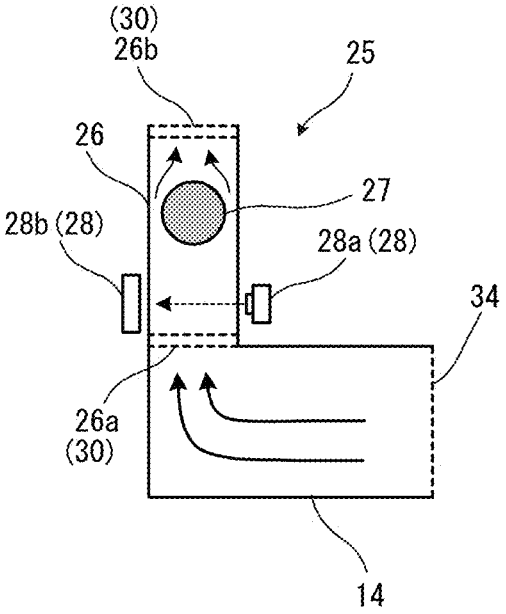
FIG. 6 is another side view of the air flow sensor illustrating the internal configuration of the air flow sensor and the detection principle.

FIG. 4 is a side view of the optional device (clean unit) 12 and a portion of the body 5 of the laser printer in the vicinity of the exhaust port 9, illustrating internal configurations of the optional device (clean unit) 12 and the portion. FIGS. 5 and 6 are side views of the air flow sensor 25 illustrating an internal configuration of the air flow sensor 25 and a detection principle. The air flow sensor 25 includes a cylindrical case 26, a to-be-detected object 27, and a photosensor 28. The cylindrical case 26 takes in part of the exhaust gas that the exhaust fan (cooling fan) 22 has discharged into the duct 15 of the clean unit 12 through the exhaust port 9. Thus, the cylindrical case 26 forms an air path different from the air flow through the duct 15. The to-be-detected object 27 floats in the cylindrical case 26. The photosensor 28 serves as a detector that detects a movement of the to-be-detected object 27 and outputs an electrical signal.

The cylindrical case 26 includes an intake port 26*a* and an exit port 26*b*. The intake port 26*a* is for the air flow (exhaust gas). The exit port 26*b* communicates with the atmosphere at a position outside the duct 15. On the outer surface of the cylindrical case 26 adjacent to the intake port 26*a*, the photosensor 28 is disposed. The air path between the intake port 26*a* and an exhaust gas intake port 34 is partitioned from the other inside elements of the duct 15 by a partition wall 14. The exhaust gas intake port 34 has an opening that faces the exhaust gas discharged from the exhaust port 9. Thus, the air path of the air flow sensor 25 to the cylindrical case 26 (the to-be-detected object 27) of the photosensor 28 is partitioned from the other inside elements of the duct 15 by the partition wall 14. This configuration ensures that even while the electric fan 24 of the clean unit 12 is in operation, the influence of the air flow from the electric fan 24 is sufficiently diminished to enable the air flow sensor 25 to accurately detect the presence or absence of the exhaust gas flowing from the body 5 of the laser printer.

The photosensor 28, which constitutes the air flow sensor 25, is a transmission-type photosensor that includes a light emitter 28*a* and an light receiver 28*b*, which face each other in the radial direction of the photosensor 28 across the cylindrical case 26. The to-be-detected object 27 is a lightweight sphere made of foam material such as styrene foam. The diameter of the to-be-detected object 27 is smaller than a minimal inner diameter of the cylindrical case 26, and thus there is a gap between the to-be-detected object 27 and the cylindrical case 26 for air flow.

When the exhaust gas (air flow) through the cylindrical case 26 has pressure lower than a predetermined level of pressure, the to-be-detected object 27 is kept at its initial position under the to-be-detected object 27's own weight. As illustrated in FIG. 5, the initial position is adjacent to the intake port 26*a* of the cylindrical case 26. While the to-be-detected object 27 is at its initial position, the light from the light emitter 28*a* of the photosensor 28 is blocked by the to-be-detected object 27 and does not reach the light receiver 28*b*. Therefore, no light detection signal is output from the light receiver 28*b*. When the pressure of the exhaust gas (air flow) through the cylindrical case 26 becomes equal to or higher than the predetermined level of pressure, the to-be-detected object 27 is pushed (forced to float) by air flow away from the initial position, as illustrated in FIG. 6. While the to-be-detected object 27 is away from its initial position, the light from the light emitter 28*a* of the photosensor 28 is not blocked by the to-be-detected object 27 and reaches the light receiver 28*b*. Then, the light receiver 28*b* outputs a light detection signal. This configuration ensures determination making as to whether the pressure of the exhaust gas (air flow) is equal to or higher than the predetermined level of pressure based on the presence or absence of the light detection signal from the light receiver 28*b*.

While the laser printer is executing print processing, the exhaust fan (cooling fan) 22 is rotating at full speed. This state corresponds to the state in which the pressure of the exhaust gas (air flow) is equal to or higher than the predetermined level of pressure. While the laser printer is not executing print processing (that is, while the laser printer is in waiting mode), the exhaust fan (cooling fan) 22 is stationary or rotating at low speed. This state corresponds to the state in which the pressure of the exhaust gas (air flow)

is lower than the predetermined level of pressure. Unless otherwise noted, the expression "presence or absence of the exhaust gas (air flow)" refers to a comparison between the state in which the pressure of the exhaust gas (air flow) is equal to or higher than the predetermined level of pressure and the state in which the pressure of the exhaust gas (air flow) is lower than the predetermined level of pressure.

The photosensor 28 will not be limited to a transmission-type photosensor. Another possible example of the photosensor 28 is a reflection-type photosensor. In the case of a reflection-type photo sensor, its light emitter and light receiver are disposed on the same side in the radial direction outside the cylindrical case 26. When the reflection-type photosensor is adjacent to the intake port 26*a* of the cylindrical case 26 similarly to FIGS. 5 and 6, the light from the light emitter is reflected at the to-be-detected object 27 and enters the light receiver while the to-be-detected object 27 is at its initial position as illustrated in FIG. 5. Then, the light receiver outputs a light detection signal. While the to-be-detected object 27 is away from its initial position as illustrated in FIG. 6, the light from the light emitter is not reflected at the to-be-detected object 27. Therefore, no light detection signal is output from the light receiver. Thus, the obtained detection signal has an inverse logic level relative to the detection signal obtained from the transmission-type photosensor.

It is necessary that the cylindrical case 26 be made of light-transmittable material (such as transparent resin) at least at the portion corresponding to the optical path between the light emitter 28*a* and the light receiver 28*b* of the photosensor 28. In order to eliminate or minimize the influence (noise) that external light has on the light receiver of the photosensor 28, it is preferable that the surrounding wall of the cylindrical case 26 be entirely coated in black (or coated with a light-non-transmittable paint) and then the paint be removed only at the portion corresponding to the optical path between the light emitter 28*a* and the light receiver 28*b* of the photo sensor 28, thereby making the portion a light-transmittable slit.

Figures 7A, 7B:
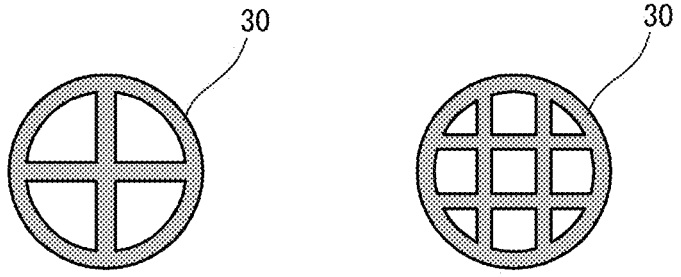
FIG. 7A is a plan view of a cross-shaped retainer disposed at or in the vicinity of the intake port and exit port of the case of the air flow sensor.
FIG. 7B is a plan view of a double-cross shaped retainer.
Figure 8:
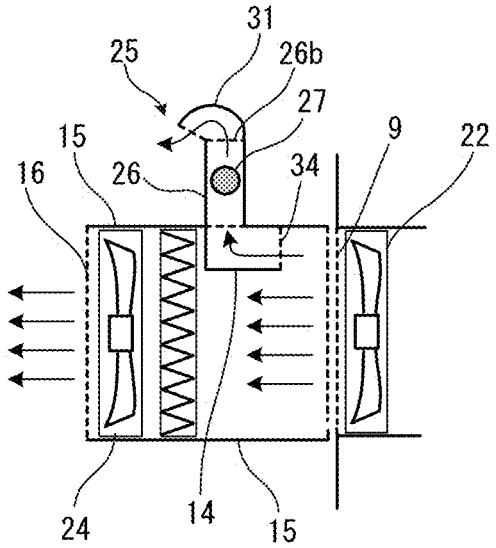
FIG. 8 is a side view of the air flow sensor with a windshield disposed at the exit port of the case of the air flow sensor.

In the vicinity of the intake port 26*a* and the exit port 26*b* of the cylindrical case 26, a retainer 30 is disposed. The retainer 30 prevents the to-be-detected object 27 from going out of the cylindrical case 26. The retainer 30 also functions as a rectifier member to rectify air flow. As illustrated in FIG. 7A, the retainer 30 is a resin article made up of a frame having a circular shape in plan view and a cross-shaped retainer integral to the frame. The retainer 30 has a predetermined level of thickness enough to function as a rectifier member. The plane shape illustrated in FIG. 7A is not intended in a limiting sense. Another possible example is illustrated in FIG. 7B, where a double-cross shaped retainer is integral to the circular frame. Still another possible example is that a lattice-shaped retainer having a larger number of squares is integral to the circular frame. As illustrated in FIG. 8, the windshield 31 is preferably disposed in the vicinity of the exit port 26*b* of the cylindrical case 26 to prevent flow of external air into the case.

Figure 9:
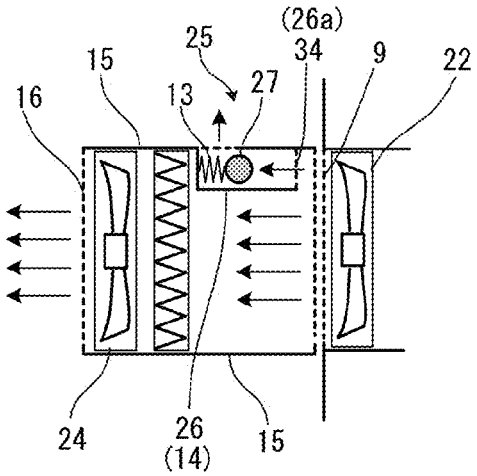
FIG. 9 is a side view of a modification of the air flow sensor.

FIG. 9 illustrates a possible modification of the air flow sensor 25. The air flow sensor 25 according to the modification is arranged in horizontal orientation. Throughout FIG. 9 and other drawings illustrating the air flow sensor 25 according to the embodiment, like reference numerals designate corresponding or identical elements, and those elements already described above will not be elaborated here. In the air flow sensor 25 according to the embodiment, the cylindrical case 26 is arranged in vertical orientation (in the perpendicular direction), and the to-be-detected object 27 in the cylindrical case 26 keeps coming back to its initial position under the to-be-detected object 27's own weight. In contrast, in the air flow sensor 25 illustrated in FIG. 9, the cylindrical case 26 is arranged in horizontal orientation (in the horizontal direction). In view of the horizontal orientation, a spring 13 is provided as biasing means for returning the to-be-detected object 27 to its initial position (which is adjacent to the intake port 26*a*).

The restoring force (biasing force) of the spring 13 is set to return the to-be-detected object 27 to its initial position when the pressure of the exhaust gas is lower than the predetermined level of pressure, and set to move the to-be-detected object 27 to the left in FIG. 9 from the initial position when the pressure of the exhaust gas is equal to or higher than the predetermined level of pressure. FIG. 9 illustrates a state in which the to-be-detected object 27 is moving away from its initial position. Also in the air flow sensor 25 illustrated in FIG. 9, the exhaust gas intake port 34 corresponds to the intake port 26*a* of the cylindrical case 26, and the wall surface of the cylindrical case 26 corresponds to the partition wall 14, which partitions the air path of the air flow sensor 25 from the inside (other inside elements) of the duct 15.

Instead of the air flow sensor 25 according to the embodiment, which uses the to-be-detected object 27 and the photosensor 28, it is possible to use a known air speed sensor as the air flow sensor. An exemplary known air speed sensor utilizes such a phenomenon that when air contacts an electric wire through which a small amount of current is flowing, the temperature of the electric wire decreases and thus its electrical resistance decreases. That is, the manner of air flow detection should be that the controller determines, based on the detection signal from the air flow sensor, the presence or absence of the exhaust gas flowing from the laser printer, as described later, and controls the operation of the electric fan 24 of the clean unit (optional device) 12 based on the determination.

Figure 10:
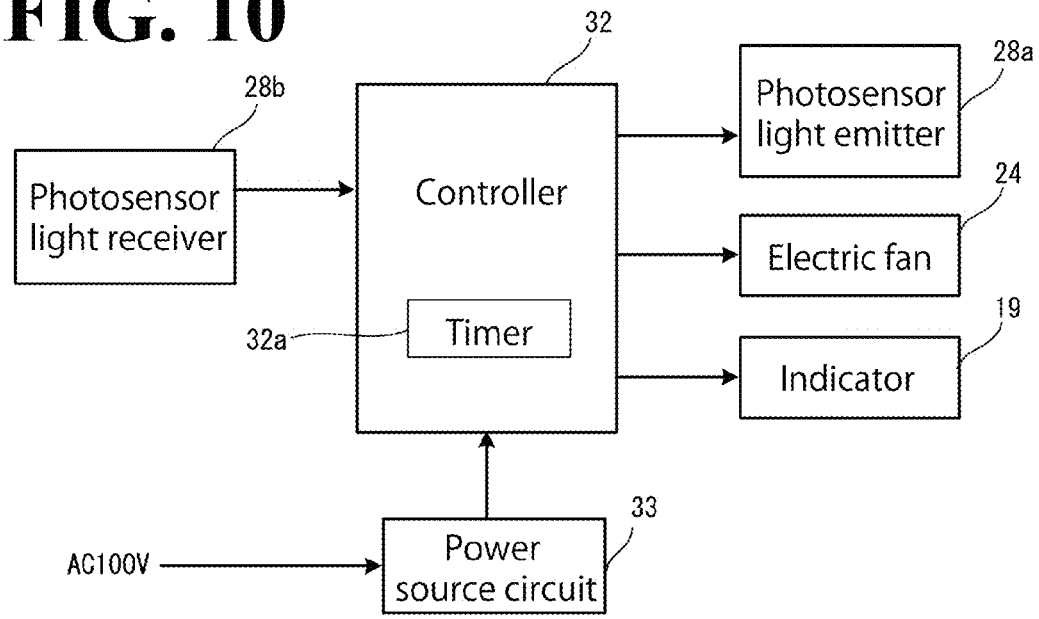
FIG. 10 is a block diagram illustrating a configuration of an electric circuit of the optional device.

FIG. 10 illustrates a configuration of the electric circuit of the clean unit 12. The clean unit 12 includes a controller 32. Based on the output signal (detection signal) from the light receiver 28*b* of the photosensor 28, which constitutes the air flow sensor 25, the controller 32 controls the electric fan 24 and the indicator 19 of the clean unit (optional device) 12. The controller 32 may be a micro-computer operable based on a program. Another possible example of the controller 32 is an electronic circuit made up of discrete parts. The controller 32 also includes a driving circuit for the electric fan 24, the indicator (LED) 19, and the light emitter (LED) 28*a* of the photosensor 28, and pulse-drives the indicator 19 and the light emitter (LED) 28*a* of the photosensor 28. A power source circuit 33, which is connected to the commercial power source (AC 100 V), generates voltage for operating the controller 32. The voltage includes voltage for operating the electric fan 24, the indicator 19, and the light emitter 28*a* of the photosensor 28.

Figure 11:
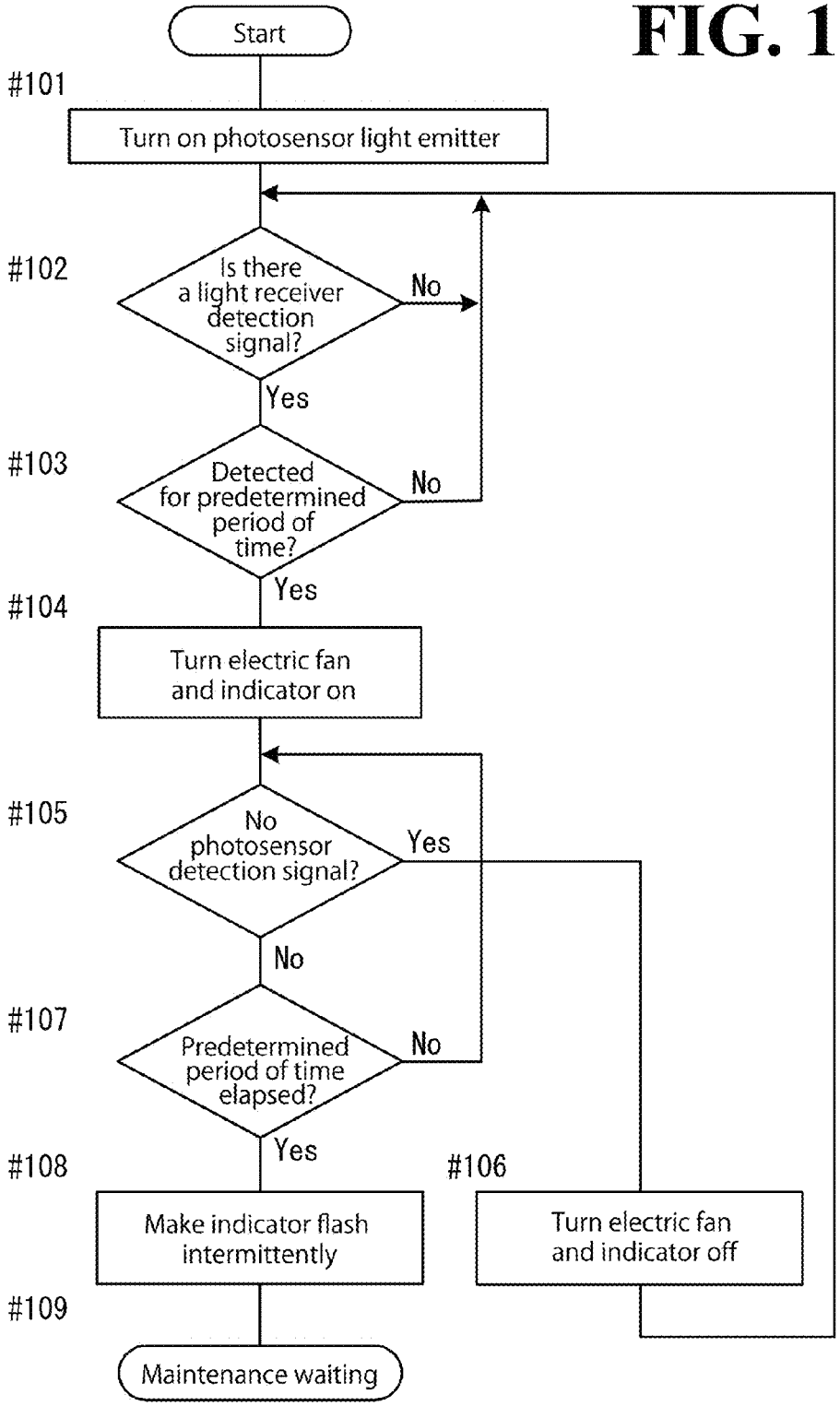
FIG. 11 is a flowchart of an example of control performed by the controller of the optional device.

FIG. 11 is a flowchart of an example of control performed by the controller 32. At step #101, the controller 32 turns on the light emitter 28*a* of the photosensor 28, and at step #102 checks the presence or absence of a detection signal from the light receiver 28*b* of the photosensor 28 (for example, checks for high-level state). That is, the controller 32 checks the operation mode of the laser printer from the presence or absence of the exhaust gas flowing from the laser printer, and determines whether to activate the electric fan 24 (clean unit 12).

As described above, while the laser printer is executing print processing, the exhaust fan (cooling fan) 22 is rotating at full speed. While the exhaust fan (cooling fan) 22 is rotating at full speed, the to-be-detected object 27 of the air flow sensor 25 is forced to float by the pressure of the exhaust gas (air flow), allowing the light from the light emitter 28*a* of the photosensor 28 to be input into the light receiver 28*b* of the photosensor 28, instead of being blocked by the to-be-detected object 27. This state corresponds to the state in which there is a detection signal from the light receiver 28*b* of the photosensor 28. While the laser printer is not executing print processing (that is, in waiting mode), the exhaust fan (cooling fan) 22 is stationary or rotating at low speed. While the exhaust fan (cooling fan) 22 is stationary or rotating at low speed, the to-be-detected object 27 of the air flow sensor 25 is at its downward position (initial position) under the to-be-detected object 27's own weight. Thus, the light from the light emitter 28*a* of the photosensor 28 is blocked by the to-be-detected object 27 and does not reach the light receiver 28*b* of the photosensor 28. This state corresponds to the state in which there is no detection signal from the light receiver 28*b* of the photosensor 28 (for example, low-level state). Thus, the controller 32 checks the presence or absence of (checks for high-level state or low-level state of) the detection signal from the light receiver 28*b* of the photosensor 28 so as to determine the presence or absence of the exhaust gas flowing from the laser printer (that is, determine the operation mode of the laser printer). Based on the determination, the controller 32 controls the operation of the electric fan 24 (clean unit 12).

When there is no detection signal from the light receiver 28*b* of the photosensor 28, the processing returns to the determination at step #102. That is, the electric fan 24 and the indicator 19 are kept at off state. When there is a detection signal from the light receiver 28*b* of the photosensor 28, the processing proceeds to step #103. At step #103, the controller 32 checks whether the detection signal from the light receiver 28*b* of the photosensor 28 continues for a predetermined period of time (for example, 10 seconds). When the detection signal from the light receiver 28*b* of the photosensor 28 does not continue for the predetermined period of time, that is, when the detection signal from the light receiver 28*b* of the photosensor 28 discontinues at least once during the predetermined period of time, the processing returns to the determination at step #103 (the electric fan 24 and the indicator 19 are kept at off state). The controller 32 includes a built-in timer 32*a* (see FIG. 10). The built-in timer 32*a* measures time based on an inner clock. The controller 32 uses the built-in timer 32*a* to measure time such as the predetermined period of time.

It is when the detection signal from the light receiver 28*b* of the photosensor 28 continues for the predetermined period of time that the processing proceeds to step #104 for the first time. At step #104, the controller 32 turns the electric fan 24 and the indicator 19 on. This configuration eliminates or minimizes malfunctioning of the air flow sensor 25 that can be caused by fluctuation of the air flow, vibration of a machine or a device, external noise, and other causes. The above configuration also eliminates or minimizes chattering, which is such a phenomenon that the electric fan 24 and the indicator 19 repeat turning on and off at short intervals.

Then, at step #105, the controller 32 checks whether the detection signal from the light receiver 28*b* of the photosensor 28 has discontinued. When the laser printer ends the print processing, the rotational speed of the exhaust fan (cooling fan) 22 decreases (and becomes zero after a while). Then, the detection signal from the light receiver 28*b* of the photosensor 28 discontinues. In response, at step #106, the controller 32 turns the electric fan 24 and the indicator 19 off so as to stop the operation of the clean unit 12. Then, the processing returns to step #102. At step #102, the above-described processing is repeated.

When at step #105 the detection signal from the light receiver 28*b* of the photosensor 28 has not discontinued yet (that is, when the detection signal continues), the processing proceeds to step #107. At step #107, the controller 32 checks whether a predetermined period of time (for example, 10 minutes) has elapsed from the start of the operation of the electric fan 24. If the operation of the electric fan 24 (the operation of the clean unit 12) continues for the predetermined period of time, this state is an abnormal state. In the abnormal state, the controller 32, at step #108, controls the indicator 19 to flash intermittently to notify the abnormal state to a user. Then, the laser printer turns into maintenance waiting mode, in which the laser printer is waiting for the user's processing such as resetting.

The indicator (LED) 19, which is the notification section, gives notification in three ways, namely, turn on (lighting), turn off (no lighting), and flash intermittently. Using the three ways, the indicator 19 enables the user to distinguish among normal operation state, stationary state, and abnormal state of the clean unit 12. It is possible to use any other method of distinguishably notifying the three states. For example, it is possible to use different colors of light emission such as green light for normal operation state and red light for abnormal state. The notification section may be a buzzer, which is preferable especially to notify abnormal state. It is also possible to use both the indicator (LED) and the buzzer to make the three states distinguishable.

As has been described hereinbefore, the controller 32 checks the presence or absence (checks the logic level) of the detection signal from the light receiver 28*b* of the photosensor 28, which constitutes the air flow sensor 25. In this manner, the controller 32 determines the presence or absence of the exhaust gas flowing from the laser printer (that is, determines the operation mode of the laser printer). Based on the determination, the controller 32 controls the operation of the electric fan 24 (clean unit 12). While the laser printer is executing the print processing, the exhaust fan (cooling fan) 22 is rotating at full speed and discharging exhaust gas that contains ultrafine particles. Here, the controller 32 activates the electric fan 24 (clean unit 12) based on the detection signal from the air flow sensor 25. The ultrafine particles contained in the exhaust gas is collected by the HEPA filter 23, and purified exhaust gas is discharged by the electric fan 24 from the exhaust port 16, which is on the rear surface of the electric fan 24. The electric fan 24 of the clean unit 12 rotates at a rotational speed (approximately identical air speed) that is approximately identical to the rotational speed (full rotational speed) of the exhaust fan 22, which is disposed in the body 5 of the laser printer.

For the air flow sensor 25 to accurately determine the presence or absence of the exhaust gas flowing from the laser printer (that is, determine the operation mode of the laser printer), the exhaust gas intake port 34 of the air flow sensor 25 is preferably disposed at a position where the speed of the exhaust gas is highest on a cross-section of the exhaust gas flowing through the duct 15 of the clean unit 12.

Figure 12:
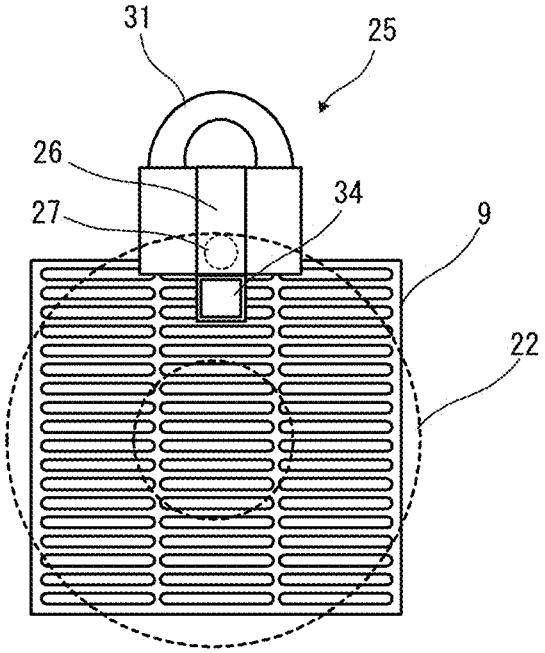
FIG. 12 is a side view of the air flow sensor illustrating the position of an exhaust gas intake port of the air flow sensor on a cross-section of exhaust gas.

FIG. 12 is a side view of the air flow sensor 25 illustrating the position of the exhaust gas intake port 34 on a cross-section of the exhaust gas. The view of the air flow sensor 25 in FIG. 12 is from inside the clean unit 12, that is, from the rear surface of the laser printer. As illustrated in FIG. 12, the exhaust gas intake port 34, which is for the exhaust gas, of the air flow sensor 25 is disposed in the center of an upper portion of the exhaust port 9. Behind the exhaust port 9 the exhaust fan 22, which is an axial flow fan, is disposed (in the body 5 of the laser printer). Generally, the strength of air flow (wind) from an axial flow fan is lower at portions closer to the center of a cross-section of the air flow and is higher at surrounding portions farther away from the center. Further, the strength of air flow (exhaust gas speed) varies even among the surrounding portions depending on situations such as the arrangement of elements in the vicinity of the exhaust fan 22. In this embodiment, the strength of air flow (exhaust gas speed) is highest at the center of an upper portion of the exhaust fan 22. In view of this, the exhaust gas intake port 34 of the air flow sensor 25 for the exhaust gas is disposed at a position corresponding to the center of the upper portion of the exhaust fan 22.

In another embodiment, the optional device may further include a filter configured to catch a particle of the exhaust gas drawn in by the electric fan, and purified air past the filter may be discharged into the atmosphere through the duct.

In another embodiment, the optional device may further include a controller configured to control an operation of the electric fan based on a detection signal from the air flow sensor.

In another embodiment, an air speed sensor may be used as the air flow sensor. An exemplary known air speed sensor utilizes such a phenomenon that when air contacts an electric wire through which a small amount of current is flowing, the temperature of the electric wire decreases and thus its electrical resistance decreases.

In another embodiment, the air flow sensor may include a to-be-detected object and a detector. The to-be-detected object is movable in the air path receiving a flow of air. The detector is configured to detect a movement of the to-be-detected object and configured to output an electrical signal.

In another embodiment, the exhaust gas intake port of the air flow sensor may be disposed at a position where a speed of the exhaust gas is highest on a cross-section of the exhaust gas flowing through the duct.

Obviously, numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An optional device for an electrical machine, the electrical machine comprising an exhaust fan and an exhaust port on which the optional device is mounted, the optional device comprising:

a duct through which an exhaust gas from the exhaust port is guided;

an electric fan configured to draw in the exhaust gas flowing through the duct and configured to discharge the exhaust gas into an atmosphere, the electric fan being provided downstream, in a flow direction of the exhaust gas, of the exhaust fan of the electrical machine; and an air flow sensor configured to detect presence or absence of the exhaust gas flowing from the electrical machine, the air flow sensor comprising an air path comprising:

an exhaust gas intake port comprising an opening facing the exhaust port of the electrical machine; and an exit port communicating with the atmosphere at a position outside the duct;

wherein the air path is provided inside the duct and is partitioned from the electric fan by a partition wall, and wherein at least a part of the air path is formed by the partition wall and an inside surface of the duct.

2. The optional device according to claim 1, further comprising a filter configured to catch a particle of the exhaust gas drawn in by the electric fan, wherein purified air past the filter is discharged into the atmosphere through the duct.

3. The optional device according to claim 1, further comprising a controller configured to control an operation of the electric fan based on a detection signal from the air flow sensor.

4. The optional device according to claim 1, wherein the air flow sensor comprises an air speed sensor.

5. The optional device according to claim 1, wherein the air flow sensor comprises a to-be-detected object movable in the air path receiving a flow of air, and a detector configured to detect a movement of the to-be-detected object and configured to output an electrical signal.

6. The optional device according to claim 1, wherein the exhaust gas intake port of the air flow sensor is disposed at a position where a speed of the exhaust gas is highest on a cross-section of the exhaust gas flowing through the duct.

7. An electrical machine comprising:

an exhaust port;

an exhaust fan configured to discharge, through the exhaust port, air in the electrical machine; and an optional device disposed on the exhaust port, the optional device comprising:

a duct through which an exhaust gas from the exhaust port is guided;

an electric fan configured to draw in the exhaust gas flowing through the duct and configured to discharge the exhaust gas into an atmosphere, the electric fan being provided downstream, in a flow direction of the exhaust gas, of the exhaust fan of the electrical machine; and an air flow sensor configured to detect presence or absence of the exhaust gas flowing from the electrical machine, the air flow sensor comprising an air path comprising:

an exhaust gas intake port comprising an opening facing the exhaust port of the electrical machine; and an exit port communicating with the atmosphere at a position outside the duct;

wherein the air path is provided inside the duct and is partitioned from the electric fan by a partition wall, and wherein at least a part of the air path is formed by the partition wall and an inside surface of the duct.

8. The optional device according to claim 7, further comprising a controller configured to control an operation of the electric fan based on a detection signal from the air flow sensor.

9. The optional device according to claim 7, wherein the air flow sensor comprises an air speed sensor.

10. The optional device according to claim 7, wherein the air flow sensor comprises a to-be-detected object movable in the air path receiving a flow of air, and a detector configured to detect a movement of the to-be-detected object and configured to output an electrical signal.

11. The optional device according to claim 7, wherein the exhaust gas intake port of the air flow sensor is disposed at a position where a speed of the exhaust gas is highest on a cross-section of the exhaust gas flowing through the duct.

* * * * *